US007350692B2

(12) United States Patent
Bushee et al.

(10) Patent No.: US 7,350,692 B2
(45) Date of Patent: Apr. 1, 2008

(54) INTERNALLY LIGHTED MAILBOX

(76) Inventors: Glenn Bushee, 1145 Franklin St., Duxbury, MA (US) 02332; Glenn M. Opendo, 129 Renaud Street, Montreal, Quebec (CA) J7V5X6; Hak Kee Chu, 19 Sheung Yuet Rd., Kowloon Bay, Kowloon, Hong Kong (CN)

( * ) Notice: Subject to any disclaimer, the term of this patent is extended or adjusted under 35 U.S.C. 154(b) by 138 days.

(21) Appl. No.: 11/446,736

(22) Filed: Jun. 1, 2006

(65) Prior Publication Data

US 2006/0289617 A1 Dec. 28, 2006

Related U.S. Application Data

(60) Provisional application No. 60/686,566, filed on Jun. 2, 2005.

(51) Int. Cl.
*A47G 29/12* (2006.01)

(52) U.S. Cl. ..... 232/38; 232/17

(58) Field of Classification Search ..... 232/38, 232/17, 45; 40/566; 362/154–155
See application file for complete search history.

(56) References Cited

U.S. PATENT DOCUMENTS 5,522,540 A * 6/1996 Surman ..... 232/17
5,813,749 A * 9/1998 Sheldon ..... 362/155
5,975,713 A * 11/1999 Brothers ..... 362/155
6,102,548 A * 8/2000 Mantle et al. ..... 362/155
6,299,325 B1 * 10/2001 Cathel ..... 362/183
6,402,338 B1 * 6/2002 Mitzel et al. ..... 362/154
6,629,634 B2 * 10/2003 Simmons ..... 232/45
6,629,766 B2 * 10/2003 Cathel ..... 362/183
6,708,876 B1 * 3/2004 Shirah ..... 232/38
6,719,193 B2 * 4/2004 Katulka ..... 232/38
2005/0162847 A1 * 7/2005 Jahn ..... 362/155
2006/0091195 A1 * 5/2006 Fletcher ..... 232/38
2006/0289617 A1 * 12/2006 Bushee et al. ..... 232/19

* cited by examiner

*Primary Examiner*—William L. Miller

(57) ABSTRACT

The interior of a mailbox is illuminated with a highly efficient LED lamp powered by a rechargeable battery. The LED lamp is turned on when the mailbox door is opened. A solar panel is mounted under a light-transmitting cover located on the roof of the mailbox for recharging the battery. The illumination system is for the most part composed of a pair of compact modular assemblies which are carried by the mailbox.

15 Claims, 8 Drawing Sheets

INTERNALLY LIGHTED MAILBOX

CROSS REFERENCE TO RELATED APPLICATION

This application claims priority benefits from U.S. Provisional Application No. 60/686,566 filed Jun. 2, 2005, "INTERNALLY LIGHTED MAILBOX".

BACKGROUND OF THE INVENTION

1. Field of the Invention

The present invention relates in general to internally illuminated mailboxes and in particular to solar-powered switch-operated light-emitting-diode (LED) illuminated mailboxes.

2. Description of Prior Developments

Mailboxes have been provided with both internal and external lighting, typically using conventional light bulbs. However, when batteries are used as a power source, conventional incandescent lighting quickly draws down the battery charge. This can cause a problem if the battery is charged by solar cells which require prolonged periods of sunlight to provide an adequate charge to the battery.

Accordingly, a need exist for a mailbox illuminated with the convenience of solar power, yet which can provide continuous illumination for up to 24 hours with a single charging, even in areas where sunlight is intermittent.

SUMMARY OF THE INVENTION

The present invention has been developed to meet the needs noted above by providing a mailbox with a solar powered LED light source which can illuminate the interior of a mailbox for periods up to 24 hours with a single charge from a conventional solar cell panel. By using one or more LED's as a light source, the draw on an electric storage battery can be minimized, and the period of illumination can be maximized.

In one embodiment, a solar panel, electronic circuitry, rechargeable battery and LED lighting are arranged in a compact assembly to minimize the space required within the interior of a mailbox so as to maximize the room available for mail. The illumination provided by the LED is controlled by a microswitch which coacts with the mailbox door so as to provide illumination only when the door is opened.

BRIEF DESCRIPTION OF THE DRAWINGS

In the drawings.

In the various views of the drawings, like reference numbers designate like or similar parts.

DESCRIPTION OF THE PREFERRED EMBODIMENTS

Figure 1:
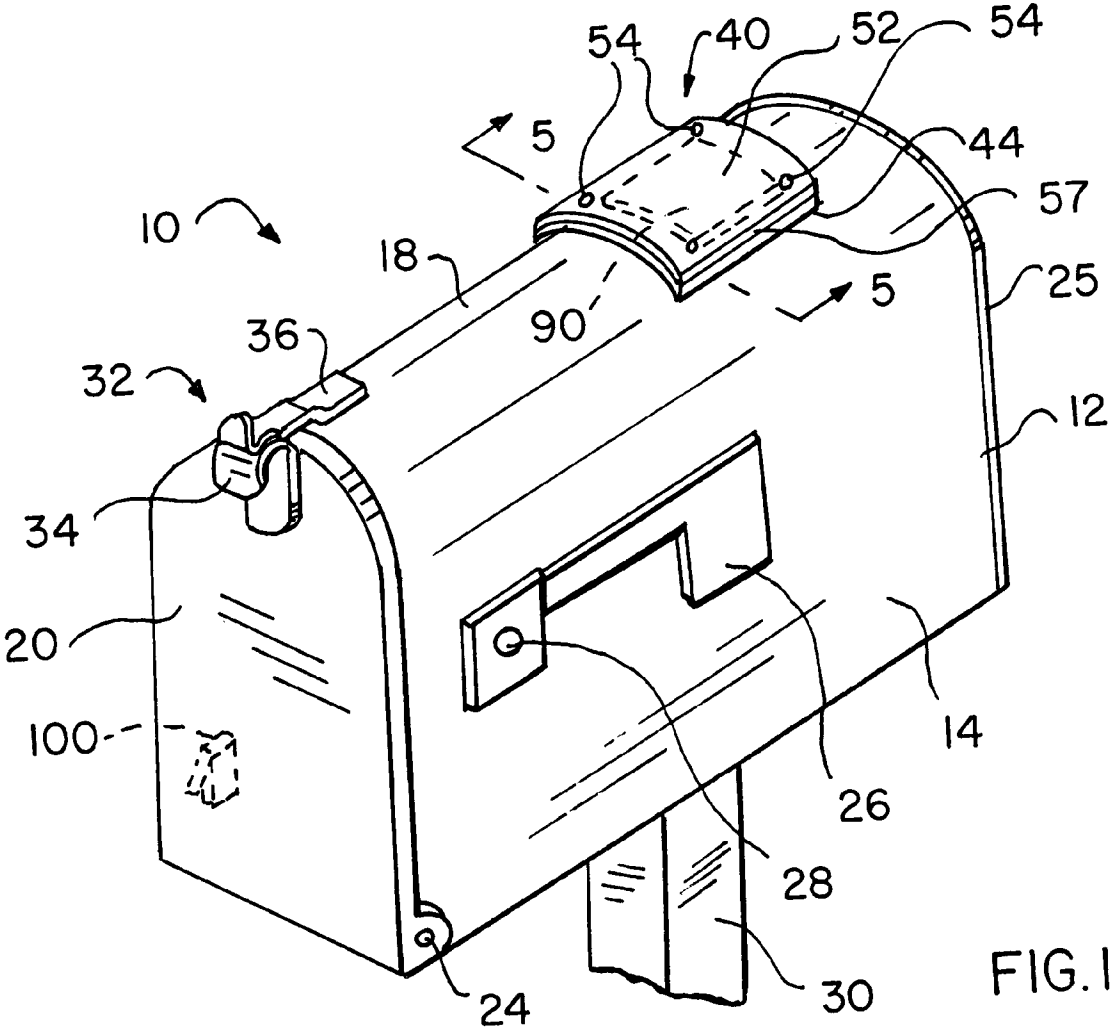
FIG. 1 is a top right perspective view of a mailbox constructed in accordance with the present invention.

The present invention will now be described in conjunction with the drawings, beginning with FIGS. 1 and 2 which show a mailbox 10 constructed in accordance with the present invention. Mailbox 10 has a body 12 which includes a pair of sidewalls 14 (FIG. 2), a floor 16, an arched roof 18, a front door 20, and a rear wall 22.

The sidewalls 14 and roof 18 may be formed of a single sheet of metal or plastic or other suitable material. In one embodiment, the roof 18 and sidewalls 14 are formed of a single thin sheet of aluminum. The floor 16, also advantageously formed of an aluminum sheet, is staked, crimped or otherwise attached to the bottom perimeter of the sidewalls 14. The front door 20, likewise formed of an aluminum sheet, is pivotally attached to the bottom front portion of sidewalls 14 by a pair of rivets or pins 24.

The rear wall 22, also formed of an aluminum sheet, is crimped around its perimeter to the rear edge of the roof 18 and sidewalls 14 along a crimped or rolled over joint 25. A flag 26 is pivotally connected to the sidewall 14 by a crimped pin, blind rivet, nut and bolt or other shaft-like connector 28. The entire body 12 is mounted on a mast or post 30 in a known fashion, such as by nails or screws 31 (FIG. 2).

A resilient over-center snap-fit retainer 32 is pinned or otherwise fixed to the top front of the roof 18 and door 20. A looped plastic handle 34 is fixed to the top center of the door 20 to provide both a finger grip and retainer for opening and retaining the door in the respective positions shown in FIGS. 2 and 1. A cantilevered plastic leaf spring retainer 36 is fixed to the top front center of roof 18 to resiliently hold and release the top arched portion of the handle 34.

Up to this point, the construction of mailbox 10 is generally of a conventional design. The invention is primarily directed to a lighting and control system for illuminating the interior of the mailbox body 12 with a highly efficient, compact and unobtrusive solar-powered battery-operated light emitting diode (LED).

A particular advantage of the subject lighting system is the use of inexpensive, commercially available "off-the-shelf" components which results in a simple and economical construction. Moreover, because of the use of rechargeable batteries in combination with a solar cell battery recharger and LED illumination, the lighting system can operate without maintenance for months or years at a time. Virtually no set-up is required.

Figure 2:
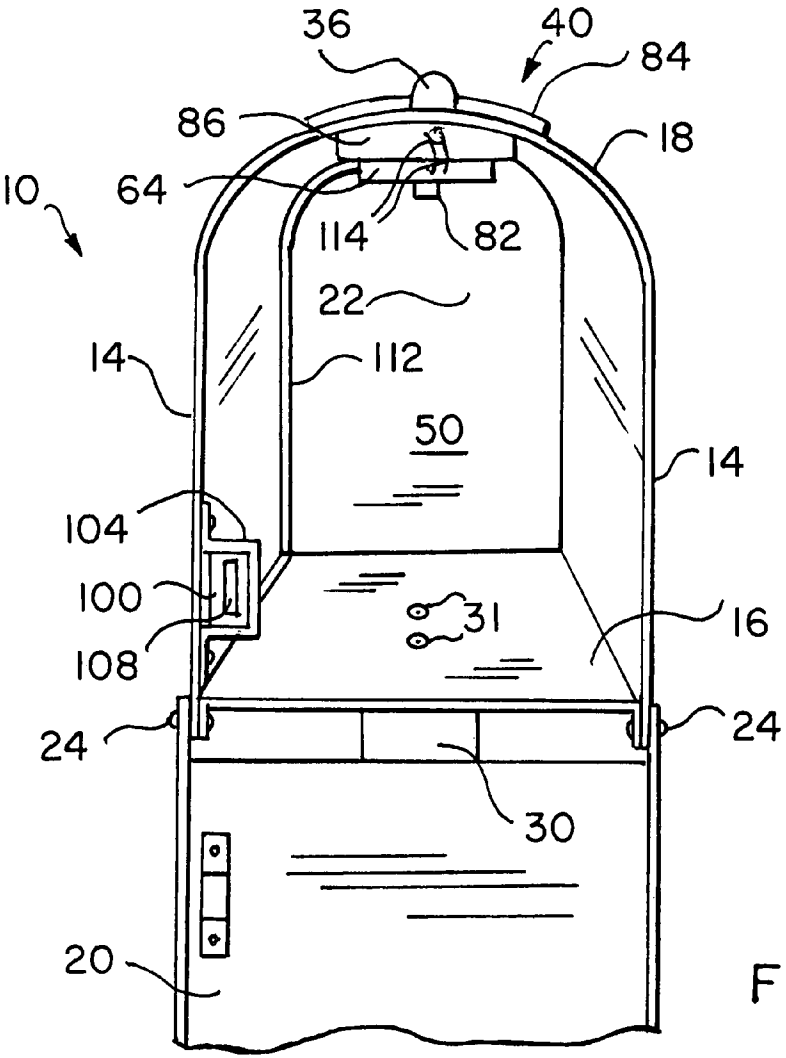
FIG. 2 is a partial front perspective view of the mailbox of FIG. 1, with the door open and showing the interior of the mailbox.
Figure 3:
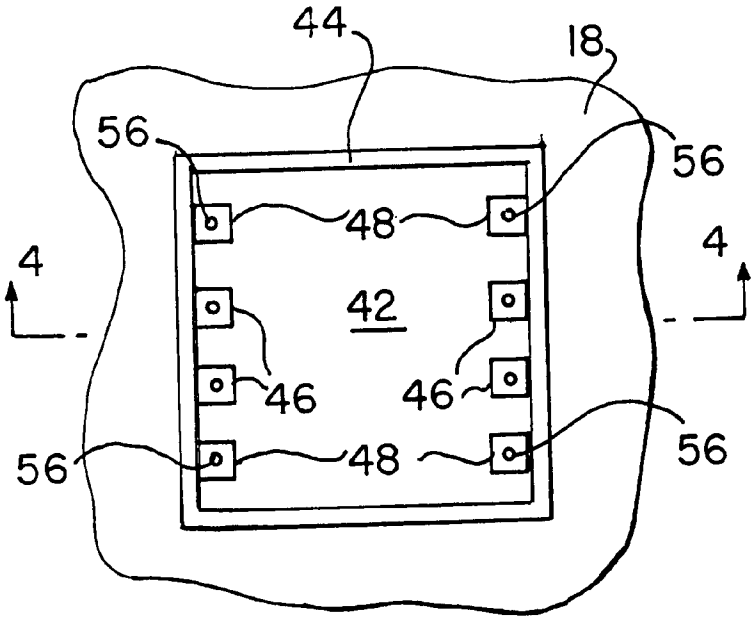
FIG. 3 is a partial top view of an aperture or mounting hole formed in the roof of the mailbox and showing the formation of mounting tabs under the aperture.
Figure 4:
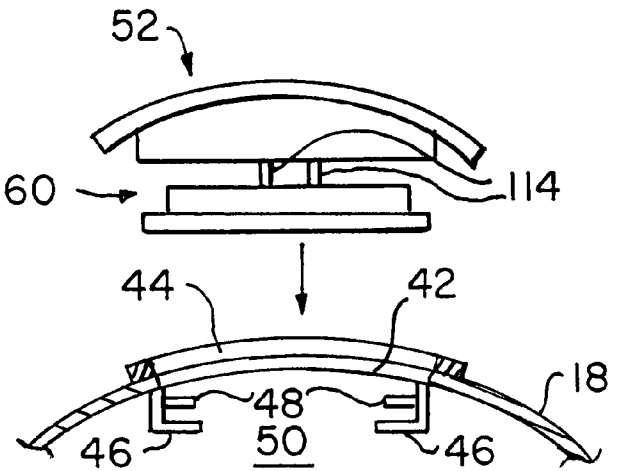
FIG. 4 is a partial exploded view of the modular subassemblies of the lighting system positioned for mounting in the roof of the mailbox.

As further seen in FIGS. 1 and 2, a modular lighting system 40, which includes a solar panel assembly and a battery assembly, is mounted on the top central rear portion of roof 18. As best seen in FIGS. 3 and 4, an aperture or cut out portion 42 is formed in roof 18 to receive the lighting system 40. Aperture 42 is shown as a rectangular or square opening, but any suitably shaped opening may be used. A rubber gasket 44 is adhesively bonded or otherwise positioned around the aperture 42.

As further shown in FIGS. 3 and 4, two sets of four stepped mounting tabs 46, 48 are formed, such as by a punching operation, from the sheet material of roof 18. The first or inner set of four tabs 46 is located between the second or outer set of mounting tabs 48 and, as seen in FIG. 4, extend further downwardly into the interior 50 of body 12 than the outer set of mounting tabs 48.

Figure 5:
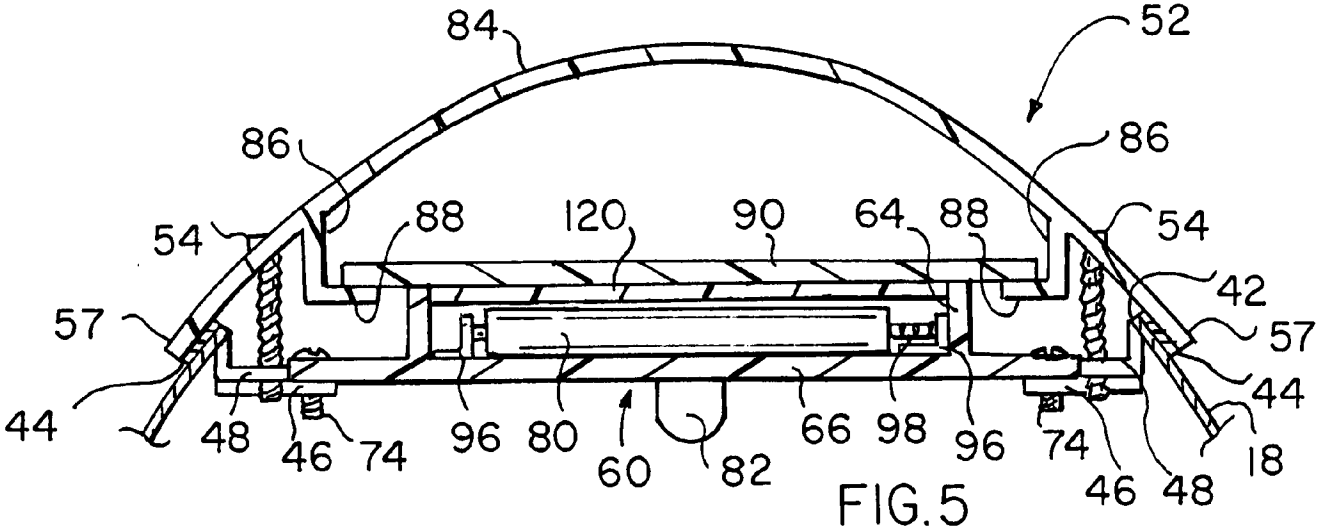
FIG. 5 is an enlarged view in section taken along section line 5-5 of FIG. 1.

A solar cell or solar panel assembly 52 is mounted within the aperture 42 as shown in FIGS. 1 and 5. Threaded fasteners such as screws 54 engage bores 56 (FIG. 3) in the outer set of mounting tabs 48 and clamp the solar panel assembly 52 to the roof 18 of mailbox 10. A perimeter flange 57 on solar panel assembly 52 engages and tightly compresses the perimeter gasket 44 against roof 18 to form a water-tight seal.

Prior to mounting the solar panel assembly 52 to the mailbox 10, a battery assembly or module 60 (FIGS. 6 and 7) is mounted to the inner set of mounting tabs 46. As seen in FIG. 7, battery assembly 60 includes a plastic casing or housing 62, having a rectangular sidewall 64 extending upwardly from a planar plastic base 66.

Four mounting tabs 68 extend outwardly, one from each corner of the battery assembly 60. Each mounting tab 68 is formed with a mounting hole 72 and dimensioned to concentrically register with each respective mounting hole in each inner mounting tab 46 on roof 18. As seen in FIG. 5, threaded fasteners 74 fix the battery assembly 60 to the mounting tabs 46, and symmetrically position the battery assembly 60 directly beneath the solar panel assembly 52.

Figure 6:
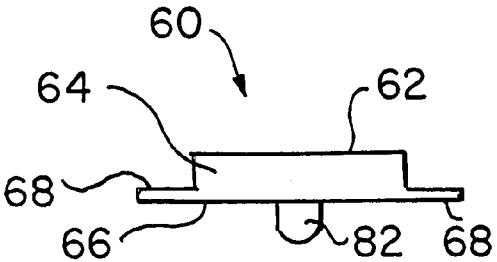
FIG. 6 is a side view of the modular battery assembly.
Figure 7:
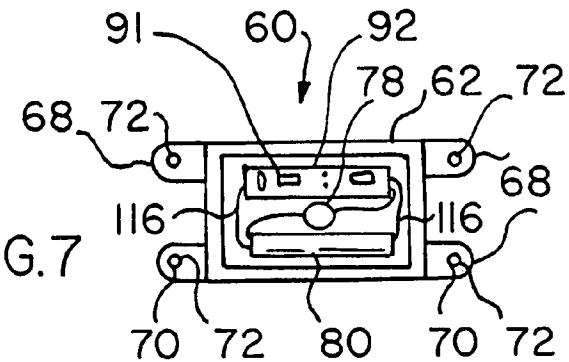
FIG. 7 is a top view of FIG. 6.

As further seen in FIGS. 5, 6 and 7, a hole or passage 78 is formed through the base 66 of housing 62 to allow for the passage of a pair of electrical power leads from a rechargeable battery 80 to one or more light sources 82, such as a small incandescent bulb, or preferably one or more LED's. LED's are preferred because of their relatively low power demand and relatively high visible light output. The LED 82 can be adhesively bonded to the base 66.

Battery 80 can be any type of rechargeable battery, such as nickel-cadmium or lithium ion battery. In the cases of a nickel-cadmium battery powering a conventional LED light source, a single day's solar charging of the battery will provide up to 24 continuous hours of illumination from the LED. This is obviously advantageous in those areas where sunlight is infrequent or intermittent, as a few hours of stored battery charge can provide weeks or months of intermittent LED illumination, depending on how often the mailbox 10 is opened, as discussed below.

Returning to FIG. 5, it is seen that the solar panel assembly 52 includes an arched or domed cover 84, formed of a light transmitting material such as clear plastic or clear glass. As shown in the embodiment of FIG. 5, cover 84 is molded from clear plastic with an arched contour substantially matching the arched contour of roof 18 and includes a downwardly depending rectangular side wall 86. A rectangular ledge 88 extends horizontally inwardly from side wall 86 to serve as a mounting platform for a solar cell panel 90. Panel 90 may be held in position on ledge 88 with an adhesive bond or with conventional clips or fasteners.

Solar cell panel 90 is of known construction and can be commonly found in such devices as solar powered outdoor landscape lighting. Panel 90 is electrically connected to a battery charging circuit board 92 (FIG. 7) mounted in housing 62 of the battery assembly or module 60. The charging circuit 91 on circuit board 92 is also of known design, and can be substantially the same as that found on outdoor solar-powered landscape lights.

Charging power from the charging circuit board 92 is transmitted to one or more rechargeable batteries 80 mounted in the housing 62 between a pair of contacts 96 (FIG. 5) and biased by a spring 92. Battery 80 (FIG. 5) is electrically connected via contacts 96 to the light source or LED 82. A switch, such as a microswitch 100 (FIGS. 1, 2 and 8), is located in the circuit's electrical leads between the battery 80 and LED 82 as discussed below.

Figure 8:
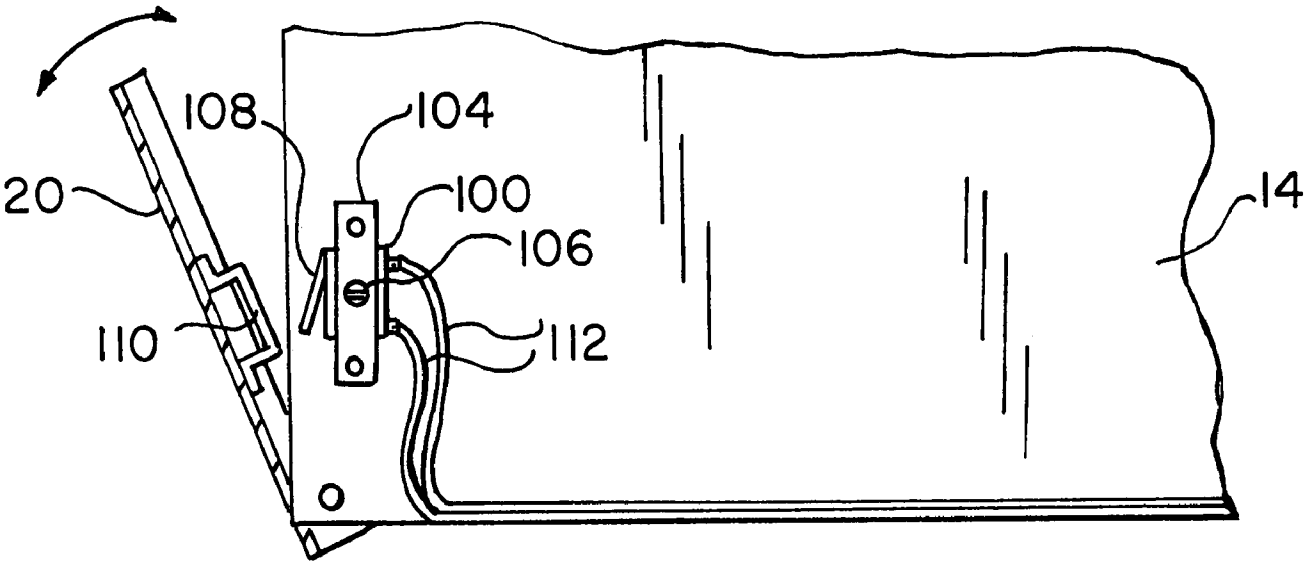
FIG. 8 is a partial view of a door-actuated switch for controlling the illumination within the mailbox.

Switch 100 is mounted on the front interior portion of one side wall 14 with a bracket 104 using a fastener such as a screw 106 (FIG. 8). Bracket 104 may be riveted to side wall 14. Switch 100 includes a conventional cantilevered spring arm or spring plunger 108 which is aligned with a switch actuator 110 fixed to the inner wall of the door 20. Actuator 110 can be any type of projection or abutment, such as a formed metal strip fixed to door 20 by rivets.

When door 20 is closed, actuator 110 engages and depresses arm 108 and opens the circuit between battery 80 and LED 82. This prevents battery 80 from powering LED 82 and thus turns off LED 82. When door 20 is opened, arm 108 is released. This closes the contacts and completes the circuit in microswitch 100 and causes power to flow from battery 80 to LED 82 via wires 112 (FIG. 8) and thereby illuminate the interior 50 of mailbox 10 only when door 20 is opened.

Figure 9:
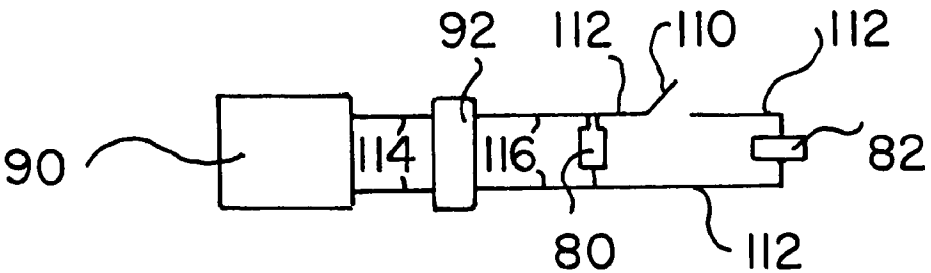
FIG. 9 is a schematic circuit of the lighting system used to illuminate the interior of the mailbox.
Figure 10:
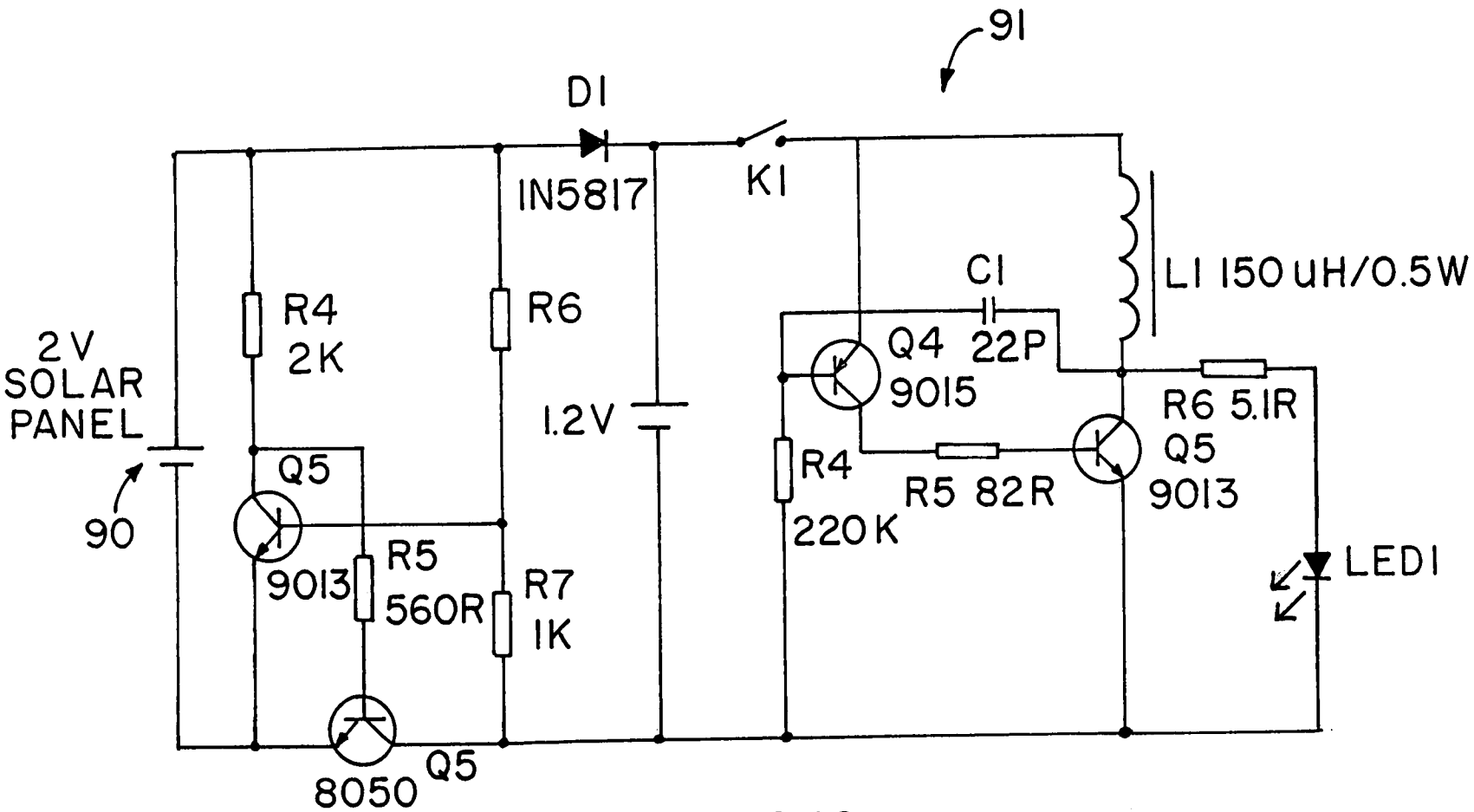
FIG. 10 is a detailed circuit diagram adapted for use with the lighting system of the present invention.

This switching arrangement conserves the charge in battery 80 and ensures reliable illumination of the interior 50 of mailbox 10 over extended periods of time. A schematic circuit of the lighting system 40 is shown in FIG. 9. Solar panel 90 receives ambient light, converts it to electricity and transmits electric power to the charging circuit board 92 via electrical leads 114 (FIG. 2). The charging circuit on circuit board 92 transmits charging voltage to battery 80 via electrical leads 116. As indicated above, battery 80 selectively powers and illuminates LED lamp 82 via switched electrical leads 112. A more detailed circuit diagram of a charging circuit 91 adapted for use with the present invention is shown in FIG. 10.

As best seen in FIGS. 1 and 5, an advantage of the present invention is the extremely compact arrangement of lighting system 40. By forming the cover 84 of solar panel 90 as an extension of and virtually flush with roof 18, the general appearance of mailbox 10 resembles that of conventional non-illuminated mailboxes.

Moreover, by vertically nesting the battery assembly 60 within the lower portion of the solar panel assembly 52, very little space is taken up within the interior 50 of mailbox 10, so as to minimize any interference or contact with mail. This also protects the lighting system 40 from damage and maximizes the room for mail. As seen in FIG. 5, a cover plate 120 is fitted on top of the battery assembly 60 to cover the circuit board 92 and battery 80. The battery assembly 60 is positioned directly against the underside of the solar panel assembly 52 and positioned and snugged against it via the positioning of the mounting tabs 46, 48. This provides an extremely compact lighting system.

Figure 11:
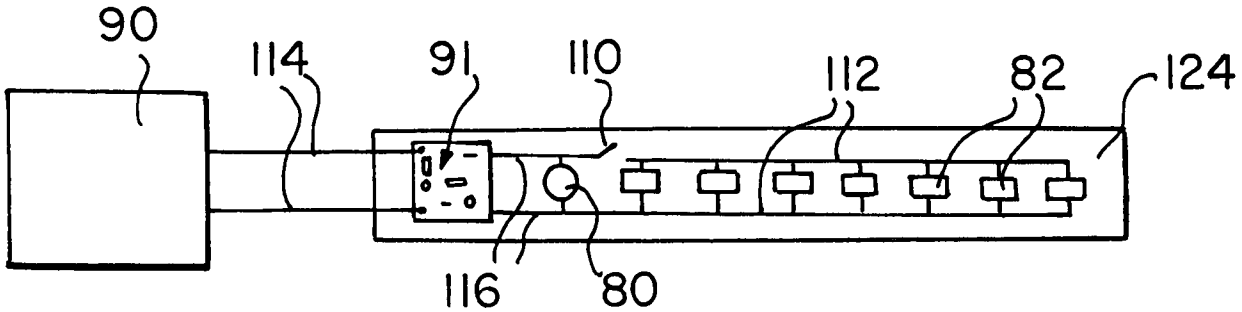
FIG. 11 is a schematic circuit similar to that of FIG. 9, showing the use of a lighting strip of surface mounted LED's.
Figure 12:
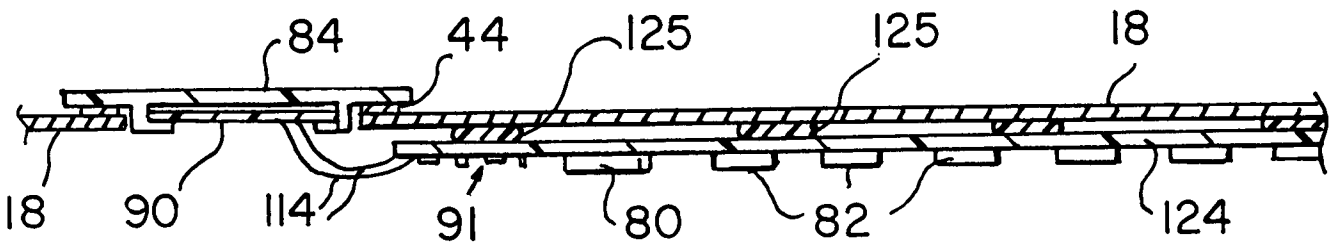
FIG. 12 is a partial view in longitudinal section taken through the central portion of the roof of the mailbox in accordance with another embodiment of the invention.

Another highly compact and space-saving embodiment of the invention is shown in FIGS. 11 and 12 wherein the light sources 82 are in the form of a series of evenly spaced apart LEDs 82 mounted longitudinally along an elongated mounting strip or circuit board 124. The LEDs 82 can be mounted to circuit board 124 using conventional "though-hole" mounting techniques. In this case, electrical leads from each LED are inserted into holes formed through the circuit board 124 and soldered to a circuit including leads 112 provided on board 124.

An even more compact and space-saving arrangement can be achieved by using surface mounted technology (SMT) to mount the LEDs 82 to the surface of board 124 without the need for any through-holes formed in circuit board 124. The electrical components of the charging circuit 91 can also be mounted to circuit board 124 using surface mount technology and surface mounted components.

While only one LED 82 need be used, by using a series of spaced-apart LED's extending from front-to rear along the roof 18 of mailbox 10, superior illumination is provided to every area within the interior 50 of the mailbox body 12. As seen in FIG. 12, circuit board 124 can be mounted to body 12 by bonding, such as by adhesive beads 125. Double sided adhesive tape, threaded fasteners or even releasable hook and loop fabric connector strips can also be used for this mounting purpose.

As further shown in FIGS. 11 and 12, rechargeable battery 80 can take the form of one or more small disk-shaped batteries of the type used in wrist watches and other small electrical appliances. These small batteries further reduce the space taken up inside the mailbox interior 50 so as to avoid contact with envelopes and other mail placed in mailbox 10.

Figure 14:
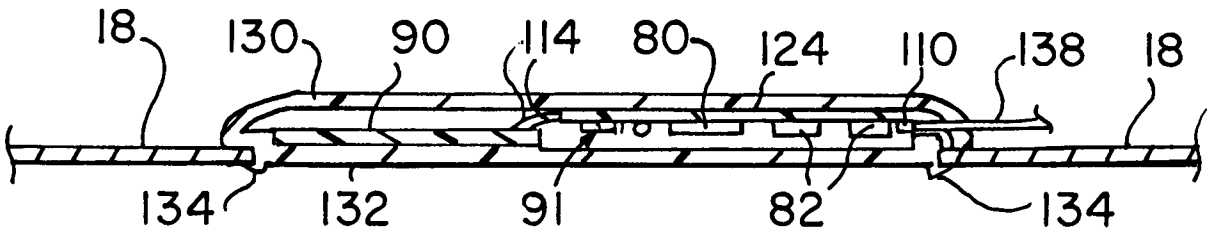
FIG. 14 is a view in section of the modular lighting assembly of FIG. 13.
Figure 13:
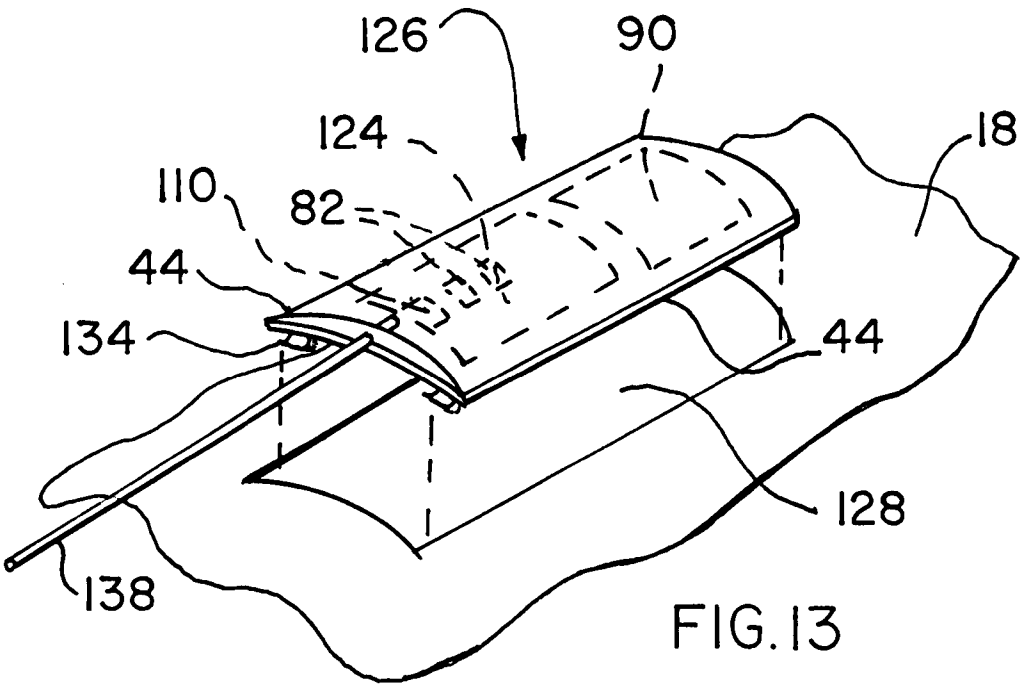
FIG. 13 is a partial perspective view of another embodiment of the invention showing a modular, unitary, self-contained lighting assembly.

Another embodiment of the invention is shown in FIGS. 13 and 14 wherein a modular self-contained lighting assembly 126 is shown disposed over the roof 18 of mailbox 10. An opening, cut out or aperture receives the module 126.

As seen in FIG. 14, module 126 can be formed as a hollow, watertight plastic compartment having a thin, low unobtrusive profile. A roof or upper shell 130 can be adhesively bonded to a floor or lower shell 132 to form module 126. Each shell 130, 132 can be formed at least in part of a clear light-transmitting plastic material to allow solar cell panel 90 to receive sunlight and to allow light sources 82 to transmit light into the interior 50 of mailbox 10.

Module 126 can be mounted to virtually any apertured portion of mailbox 10, except perhaps the bottom or floor 16, which would not likely receive sufficient sunlight to charge the solar cell panel 90. Virtually any type of mounting may be used to mount module 126 to mailbox 10, including adhesives, threaded fasteners, brackets, and press fits. In the example shown in FIGS. 13 and 14, integral snap-fit spring hooks 134 are molded homogeneously with the lower shell 132 to allow for a simple snap-fit mounting of module 126 to mailbox 10.

Module 126 houses and encloses the solar panel 90, charging circuit 91, battery 80 and light source(s) 82. The thin flat circuit board 126 of FIG. 11 is well suited for use with module 126, as it can be produced with a very low profile.

Module 126, as shown in FIG. 13, can be mounted during initial manufacture of mailbox 10, or can be supplied as a stand-along retrofit unit. In this case, all that is required is the cutting of an aperture 128 in mailbox body 12 of an appropriate predetermined size that may be formed with a stencil provided with an after market module 126. All that is required than is a simple snap-fit of module 126 into aperture 128. A gasket 44 may be provided around the bottom periphery of bottom shell 132 to provide a watertight seal against the mailbox.

A plunger rod 138 is connected to a microswitch 110 mounted inside module 126. Plunger rod 138 can be cut to length to normally engage the rear face of handle 34 (FIG. 1) and actuate microswitch 110. When the mailbox door 20 is opened, plunger rod 138 moves forwardly to close microswitch 110 and illuminate the LED's 82. When the door 20 is closed, microswitch 110 is opened.

Of course, any other suitable switching arrangement can be used to actuate microswitch 110, such as a proximity senor switch which can sense a user opening the mailbox. Plunger rod 138 can be eliminated in this case and, the proximity switch can be mounted in module 126 so that module 126 can be completely sealed and self-contained. Capacitance type proximity switches are commercial available for this application.

There has been disclosed heretofore the best embodiment of the invention presently contemplated. However, it is to be understood that various changes and modifications may be made thereto without departing from the spirit of the invention.

What is claimed is:

1. A mailbox, comprising:

a body defining an interior space for receiving mail;

a roof provided on said body; and a lighting system coupled to said roof, said system comprising a solar panel assembly and a rechargeable battery assembly charged by said solar panel assembly, wherein said roof defines a roof contour and wherein said solar panel assembly comprises a light-transmitting cover and a solar cell arrangement, said cover having a contour substantially the same as said roof contour and said solar cell arrangement adapted to receive sunlight through said cover.

2. The mailbox of claim 1, further comprising a door mounted on said body, and a switch activated by said door and electrically connected to said battery assembly.

3. The mailbox of claim 2, further comprising a light source powered by said battery assembly and switched on and off by said switch.

4. The mailbox of claim 3, wherein said light source comprises a light emitting diode.

5. The mailbox of claim 1, wherein said solar panel assembly comprises a modular solar panel assembly and wherein said battery assembly comprises a modular battery assembly.

6. The mailbox of claim 5, wherein said modular battery assembly is positioned adjacent to and below said modular solar panel assembly.

7. The mailbox of claim 1, wherein said lighting system is located on a rear portion of said roof.

8. A mailbox, comprising:

a body defining an interior space for receiving mail;

a light-transmitting cover supported by said body;

a solar cell arrangement supported by said body and adapted to receive sunlight through said cover;

a battery charging circuit connected to said solar cell;

a rechargeable battery connected to said battery charging circuit;

a light source connected to said battery for illuminating said interior space; and a switch electrically connected between said light source and said battery for operating said light source.

9. The mailbox of claim 8, wherein said solar cell arrangement comprises a solar cell panel and wherein said light source comprises a light-emitting diode.

10. The mailbox of claim 8, further comprising a door pivotally mounted on said body and adapted to operate said switch.

11. The mailbox of claim 8, further comprising a modular solar panel assembly including said light-transmitting cover and said solar cell arrangement, and a modular rechargeable battery assembly including said battery charging circuit and said rechargeable battery.

12. The mailbox of claim 8, further comprising a door provided on said body for accessing said interior space, wherein said switch is located in said interior space, and wherein said door is adapted to operate said switch.

13. The mailbox of claim 8, further comprising a circuit board coupled to said body and wherein said battery charging circuit, said rechargeable battery and said light source are mounted on said circuit board.

14. The mailbox of claim 13, wherein said switch is arranged to extinguish said light source when said door is closed.

15. The mailbox of claim 8, further comprising a watertight seal provided between said body and light-transmitting cover.

* * * * *